US011031722B2

(12) United States Patent
Gong et al.

(10) Patent No.: US 11,031,722 B2
(45) Date of Patent: Jun. 8, 2021

(54) SEALING COVER, UPPER COVER ASSEMBLY, AND COMPRESSOR

(71) Applicant: PANASONIC WANBAO APPLIANCES COMPRESSOR (GUANGZHOU) CO., LTD., Guangzhou (CN)

(72) Inventors: Pei Gong, Guangzhou (CN); Junli Chui, Guangzhou (CN); Takamasa Sakimoto, Guangzhou (CN); Toru Aya, Guangzhou (CN); Yan Deng, Guangzhou (CN)

(73) Assignee: PANASONIC WAN BAO APPLIANCES COMPRESSOR (GUANGZHOU) CO., LTD., Guangzhou (CN)

( * ) Notice: Subject to any disclaimer, the term of this patent is extended or adjusted under 35 U.S.C. 154(b) by 0 days.

(21) Appl. No.: 16/693,985

(22) Filed: Nov. 25, 2019

(65) Prior Publication Data

US 2020/0091649 A1 Mar. 19, 2020

Related U.S. Application Data

(63) Continuation of application No. PCT/CN2019/076669, filed on Mar. 1, 2019.

(30) Foreign Application Priority Data

Aug. 20, 2018 (CN) ..... 201810947865.7

(51) Int. Cl.
*H01R 13/50* (2006.01)
*H01R 13/52* (2006.01)
(Continued)

(52) U.S. Cl.
CPC ..... *H01R 13/50* (2013.01); *H01R 13/41* (2013.01); *H01R 13/521* (2013.01);
(Continued)

(58) Field of Classification Search
CPC .... H01R 13/50; H01R 13/41; H01R 13/5202; H01R 13/5208
(Continued)

(56) References Cited

U.S. PATENT DOCUMENTS 4,326,096 A * 4/1982 Leitmann ..... H01J 29/925 174/84 R
4,566,746 A * 1/1986 Hobson ..... H01J 29/925 439/588
(Continued)

FOREIGN PATENT DOCUMENTS

CN 1397732 A 2/2003
CN 1499559 A 5/2004
(Continued)

OTHER PUBLICATIONS

Office Action in related Japanese Patent Application No. 2019-572812 dated Dec. 22, 2020. 5 pages.
(Continued)

*Primary Examiner* — Alexander Gilman
(74) *Attorney, Agent, or Firm* — Schmeiser, Olsen & Watts, LLP

(57) ABSTRACT

Provided is a sealing cover including a cover body and a wire fixing part; the cover body includes a top cover and a side wall, and the cover body is of a half-surrounded structure; the wire fixing part includes a bottom plate and a side plate, the bottom plate is arranged in the cover body, a wire accommodating space is formed by the top cover and the side wall of the cover body and the bottom plate, and a fitting space is formed by the side wall and a side of the
(Continued)

bottom plate that opposite to the wire accommodating space; the side plate is arranged in the wire accommodating space, and wire guide slots are formed between the side plate and the bottom plate; and the guide holes are arranged on the bottom plate.

16 Claims, 6 Drawing Sheets

(51) Int. Cl.
*H01R 13/41* (2006.01)
*H01R 24/76* (2011.01)
*H01R 105/00* (2006.01)

(52) U.S. Cl.
CPC ..... *H01R 13/5202* (2013.01); *H01R 13/5208* (2013.01); *H01R 24/76* (2013.01); *H01R 2105/00* (2013.01); *H01R 2201/10* (2013.01)

(58) Field of Classification Search
USPC ..... 439/521
See application file for complete search history.

(56) References Cited

U.S. PATENT DOCUMENTS 4,838,816 A 6/1989 Matsusaka et al.
4,894,023 A * 1/1990 Hall ..... H01J 29/925 439/278
5,131,858 A * 7/1992 Heimbrock ..... H01R 13/53 439/181
5,199,898 A * 4/1993 Wisner ..... H01R 23/10 439/367
5,364,283 A 11/1994 Katoh et al.
5,580,282 A * 12/1996 Paterek ..... H01R 13/521 439/271
5,795,170 A 8/1998 Okabe
6,699,078 B2 * 3/2004 Quadir ..... H01R 13/53 439/272
6,752,646 B2 * 6/2004 McCoy ..... H01R 13/447 439/367
6,760,216 B2 * 7/2004 Seo ..... H02B 1/06 248/510
6,910,904 B2 * 6/2005 Herrick ..... F04B 39/121 439/271
7,234,976 B2 * 6/2007 Takeda ..... F04B 39/12 439/597
7,530,836 B2 * 5/2009 Cox ..... H01R 4/2433 439/409
7,976,330 B2 * 7/2011 Lin ..... H01R 4/4818 439/353
8,262,372 B2 * 9/2012 Wang ..... F04C 23/008 417/410.1
8,529,278 B2 * 9/2013 Shiga ..... H01R 43/20 439/272
8,794,999 B2 * 8/2014 Schuckmann ..... H01R 13/44 439/587
8,939,735 B2 * 1/2015 Heidecker ..... F04B 39/121 417/410.1
9,246,320 B2 * 1/2016 Yamada ..... F04B 39/121
9,472,871 B2 * 10/2016 Lin ..... H01R 12/53
9,929,496 B1 * 3/2018 Weiden ..... H01R 13/5841
2002/0029469 A1 3/2002 Bunch et al.
2002/0049004 A1 4/2002 Davis et al.
2002/0155741 A1 10/2002 Herrick et al.
2004/0027790 A1 2/2004 Seo
2018/0013225 A1 1/2018 Li et al.

FOREIGN PATENT DOCUMENTS

CN 101201048 B 2/2011
CN 202768328 U 3/2013
CN 104838139 A 8/2015
CN 206060438 U 3/2017
CN 206236905 U 6/2017
CN 107514364 A 12/2017
CN 206947565 U 1/2018
CN 108075253 A 5/2018
CN 108204352 A 6/2018
CN 207518409 U 6/2018
CN 106609756 B 8/2018
CN 208723128 U 4/2019
EP 3322043 A1 5/2018
JP H05321840 A 12/1993
JP H10238466 A 9/1998
JP 2000027757 A 1/2000
JP 2002237347 A 8/2002
JP 2004003516 A 1/2004
JP 2006220000 A 8/2006

OTHER PUBLICATIONS

Office Action in corresponding Chinese Patent Application No. 201980004420.8 dated Oct. 27, 2020. 10 pages.
Extended European Search Report in European Patent Application No. 19805871.1 dated Feb. 8, 2021. 10 pages.

* cited by examiner

SEALING COVER, UPPER COVER ASSEMBLY, AND COMPRESSOR

CROSS-REFERENCE TO RELATED APPLICATIONS

This application is a continuation application to PCT/CN2019/076669, with an international filling date of Mar. 1, 2019, which is based upon and claims priority to Chinese Patent Application No. 201810947865.7, having a filing date of Aug. 20, 2018, the entire contents both of which are incorporated herein by reference

FIELD OF TECHNOLOGY

The following relates to the field of compressors, in particular to a sealing cover, an upper cover assembly, and a compressor.

BACKGROUND

Compressors which are used to convert low-pressure gases into high-pressure gases have been widely applied to the field of air conditioners, or other fields, wherein one compressor includes a shell and an upper cover assembly mounted on the shell; a pump, a motor, and other assemblies are arranged in the shell; the upper cover assembly includes an upper cover body, a terminal post fixing base embedded in the upper cover body, terminal posts embedded in the upper cover body and penetrating through the terminal post fixing base, and the terminal posts are connected with the motor, wiring terminals connected with the terminal posts and an external power supply, and a terminal post protection cover connected with the upper surface of the terminal post fixing base and used to cover the terminal posts and the wiring terminals.

SUMMARY

An aspect relates to a sealing cover includes a cover body and a wire fixing part. The cover body includes a top cover and a side wall, and is of a half-surrounded structure. The wire fixing part includes a bottom plate and side plates, the bottom plate is arranged in the cover body; a wire accommodating space is formed by the bottom plate, the top cover and the side wall; and a fitting space is formed by the side wall and a side of the bottom plate which is opposite to the wire accommodating space; the side plates are arranged on the bottom plate inside the wire accommodating space, and each two side plates are parallel; the wire accommodating space includes wire guide slots, and each wire guide slot is formed by two adjacent side plates and the bottom plate; a guide hole is arranged on the bottom plate at each wire guide slot.

BRIEF DESCRIPTION

Some of the embodiments will be described in detail, with references to the following Figures, wherein like designations denote like members, wherein.

DETAILED DESCRIPTION

The following description of the embodiments is merely illustrative in nature and is in no way intended to limit the scope of embodiments of the invention, its application, or uses.

In the process of creating embodiments of the invention, the inventor realized that when the upper cover assembly is assembled, the wiring terminals and the terminal posts should be connected first and are then covered with the terminal post protection cover, and in order to seal the terminal post protection cover, a sealant has to be injected between the wiring terminals, the terminal posts, and the terminal post protection cover. Due to the fact that the terminal post fixing base is half surrounded by the terminal post protection cover when covered with the terminal post protection cover, it is extremely inconvenient to seal the wiring terminals, the terminal posts and the terminal post protection cover, and gaps may be formed; and the positions of the wiring terminals are not constant, so that gaps may be formed between the wiring terminals, and a good sealing effect cannot be realized.

Figure 1:
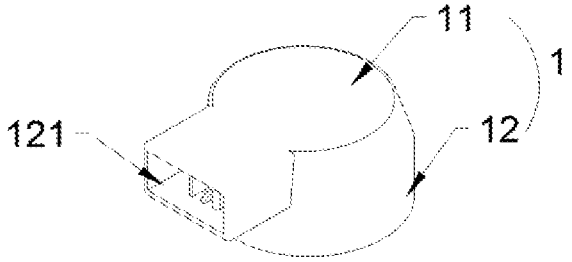
FIG. 1 is a structural diagram of a sealing cover in some embodiments of the invention.
Figure 2:
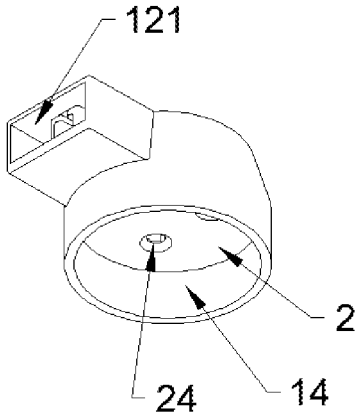
FIG. 2 is a bottom view of the sealing cover shown in FIG. 1.
Figure 3:
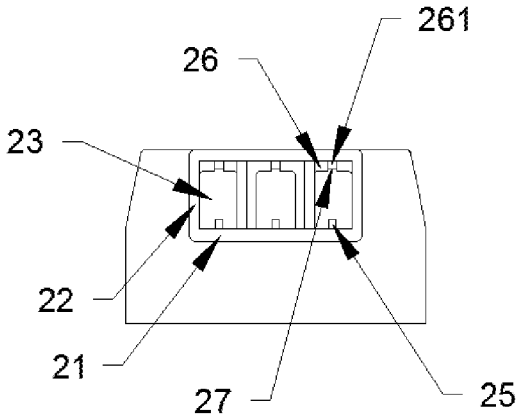
FIG. 3 is a left view of the sealing cover shown in FIG. 1.
Figure 4:
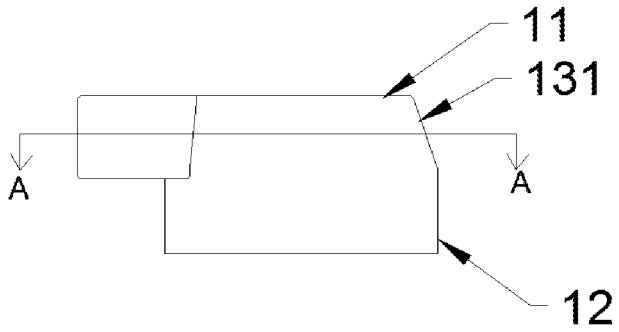
FIG. 4 is a side view of the sealing cover shown in FIG. 1.
Figure 5:
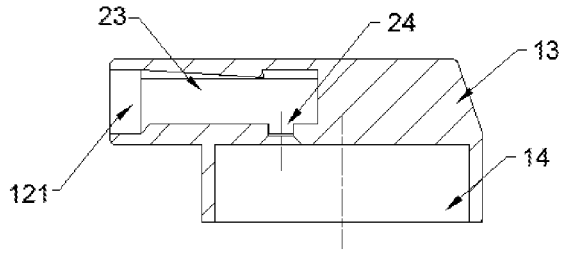
FIG. 5 is a side sectional view of the sealing cover shown in FIG. 1.

With reference to FIG. 1-FIG. 5, wherein FIG. 1 is a structural view of a sealing cover in one embodiment of the invention, FIG. 2 is a bottom view of the sealing cover shown in FIG. 1, and FIG. 3 is a left view of the sealing cover shown in FIG. 1, and FIG. 4 is a side view of the sealing cover shown in FIG. 1, and FIG. 5 is a side sectional view of the sealing cover shown in FIG. 1. In some embodiments, a sealing cover includes a cover body 1 and a wire fixing part 2. The cover body 1 is formed by a top cover 11 and a side wall 12, and the cover body 1 is of a half-surrounded structure. The wire fixing part 2 includes a bottom plate 21 and side plates 22; the bottom plate 21 is arranged in the cover body 1 and is parallel with the top cover 11, and a wire accommodating space 13 used for accommodating wiring terminals is formed by the top cover 11 and the side wall 12 and the bottom plate 21. A fitting space 14 is formed by the side wall 12 and a side of the bottom plate 21 which is opposite to the wire accommodating space. And the sealing cover is mounted on a terminal post fixing base by the fitting space 14. The side plates 22 are arranged in the wire accommodating space 13, and the side plates 22 are fixed vertically on the bottom plate 21, each two adjacent side plates 22 are parallel with each other and each two adjacent side plates 22 forms a wire guide slot 23 with the bottom plate 21. In some embodiments, each two adjacent side plates 22 are connected by a connecting plate. The wiring terminals can be inserted and can be fixed in the wire guide slots 23. Guide holes 24 are arranged on the bottom plate 21 at each wire guide slot 23, and the wire guide slots 23 are communicated with the fitting space 14 via the guide holes 24.

Wire guide ports 121 are arranged on the side wall 12 and are communicated with the wire guide slots 23, so that the wiring terminals can penetrate through the wire guide ports 121 to be inserted into the wire guide slots 23.

In some embodiments, a chamfer 131 is disposed on the outer side of the wire accommodating space 13, so that the sealing cover can be held to be assembled over the terminal post fixing base conveniently, the size of the sealing cover is reduced, transportation and carrying of the sealing cover are facilitated, and the sealing cover is more attractive.

The side plates 22 of the wire fixing part 2 are fixed to the top cover 11. In some embodiments, the number of the wire guide slots 23 is three, matching with the number of terminal posts arranged on the terminal post fixing base.

The wiring terminals 3 can be conveniently inserted into the cover body 1 via the wire guide slots 23, and a sealant can be conveniently injected into the wire guide slots 23 to effectively seal the wiring terminals; and the sealing cover can be conveniently mounted on the terminal post fixing base via the fitting space 14, and the terminal posts on the terminal post fixing base penetrate through the guide holes 24 to be in close contact with the wiring terminals 3 in the wire guide slots 23, so that the wiring terminals 3 and the terminal posts are electrically connected. The sealing cover is conveniently and effectively assembled on the terminal post fixing base in a sealing manner, and the wiring terminals 3 and the terminal posts are conveniently connected and sealed.

Figure 6:
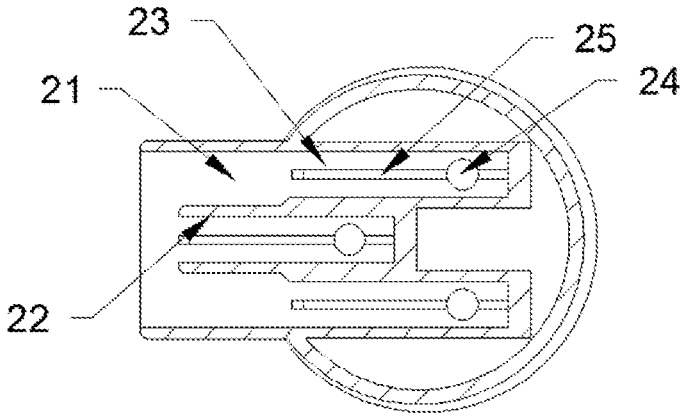
FIG. 6 is a sectional view along A-A shown in FIG. 4 in some embodiments.
Figure 7:
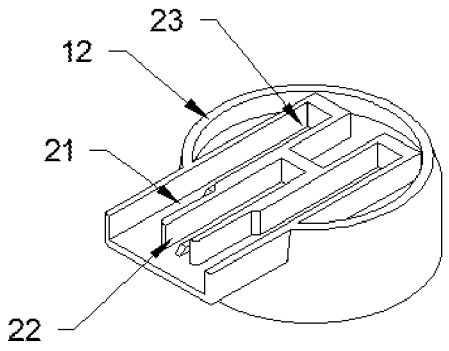
FIG. 7 is a side view of the sectional structure shown in FIG. 6.

Please refer to FIG. 6 and FIG. 7, wherein FIG. 6 is a sectional view along A-A shown in FIG. 4, and FIG. 7 is a side view of the sectional structure shown in FIG. 6.

In some embodiments, the sealing cover is produced by integrated injection molding. Aiming to facilitate machining and manufacturing, the space between the side plate 22 and the side wall 12 is filled to be solid.

Figure 8:
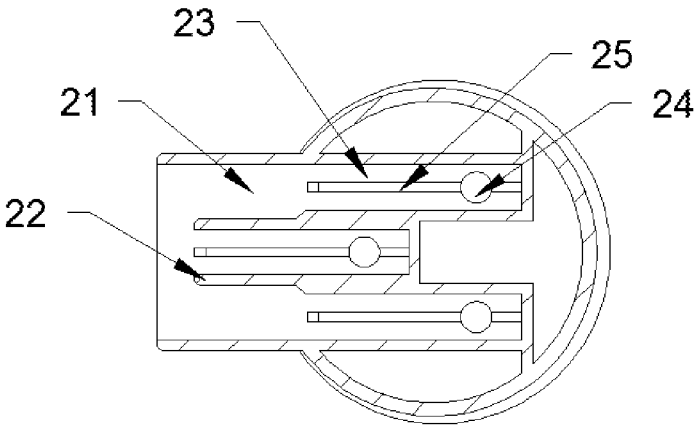
FIG. 8 is a sectional view along A-A shown in FIG. 4 in some embodiments.
Figure 9:
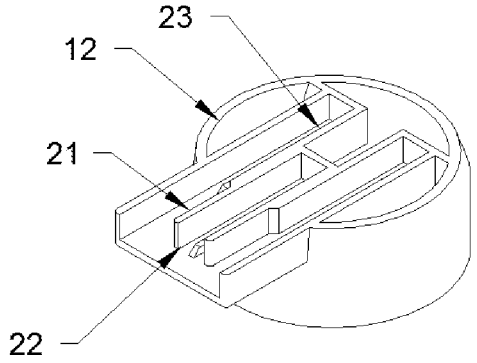
FIG. 9 is a side view of the sectional structure shown in FIG. 8.

Please refer to FIG. 8 and FIG. 9, wherein FIG. 8 is a sectional view along A-A shown in FIG. 4 in some embodiments, and FIG. 9 is a side view of the sectional structure shown in FIG. 8.

Since the sealing cover is integrally formed by injection molding, the outer side of the sealing cover is thin and cools down rapidly, while the inner side of the sealing cover is solid and thick and thus cools down slowly, deformation of the sealing cover or cracks of the inner side of the sealing cover may be caused by thermal expansion and cold shrinkage, which in turn decreases the injection-molding yield. Therefore, in some embodiments, two of the side plates 22, which are nearest to the side wall 12, are fixed to the side wall 12, and the space between the side plate 22 of the wire fixing part 2 and the side wall 12 of the cover body 1 is set to be hollow to prevent deformation or cracks of the sealing cover and to increase the yield.

Figure 10:
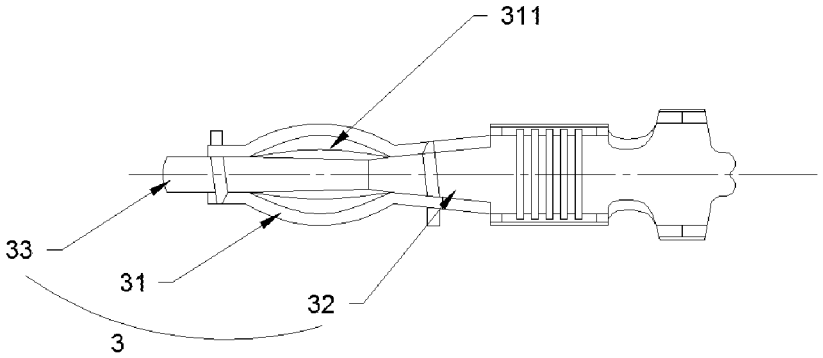
FIG. 10 is a structural view of a wiring terminal in some embodiments of the invention.
Figure 11:
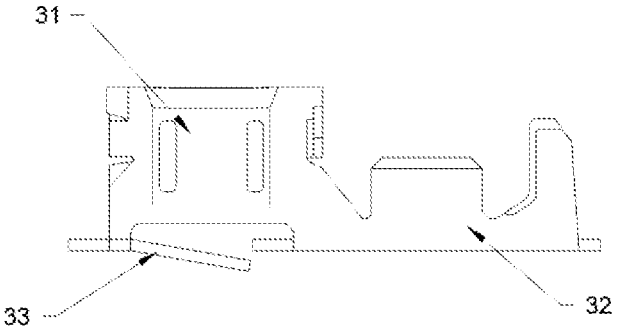
FIG. 11 is a side view of the wiring terminal shown in FIG. 10.

Please refer to FIG. 3, FIG. 10, and FIG. 11, wherein FIG. 3 is a left view of the sealing cover shown in FIG. 1, and FIG. 10 is a structural view of one wiring terminal in some embodiments of the invention, and FIG. 11 is a side view of the wiring terminal shown in FIG. 10.

In some embodiments, the sealing cover further includes wiring terminals 3. Each wiring terminal 3 includes an electrical connector 31 and a lead wire fixing base 32, wherein the electrical connector 31 is fixedly connected to one end of the lead wire fixing base 32 and is inserted into the wire guide slot 23, and the lead wire fixing base 32 is exposed out of the wire guide slot 23 to be connected with an external power line, so that the power line and the electrical connector 31 are electrically connected.

The electrical connector 31 includes two clamping pieces, wherein one end of each clamping piece is fixed to the lead wire fixing base 32, the two clamping pieces are symmetrically disposed on opposite sides of the lead wire fixing base 32, and a clamping gap 311 is formed between the two clamping pieces. In some embodiments, the wire fixing part 2 further includes positioning bars 25 for positioning the wiring terminals inserted into the wire guide slots 23, and the positioning bars 25 are disposed on the bottom plate 21 of each wire guide slot 23, paralleling with the axial direction of the wire guide slot 2. The guide holes 24 are disposed on the positioning bars 25. When the electrical connector 31 is inserted into the wire guide slot 23, the positioning bar 25 in the wire guide slot 23 is clamped by the two clamping pieces, so that the lower side of the clamping gap 311 is propped open by the positioning bar 25 to fix the electrical connector 31. Wherein, the width of the clamping gap 311 is smaller than the diameter of the terminal post, so that after the fitting space 14 of the sealing cover is mounted on the terminal post fixing base, the terminal post further props the clamping gap 311 open to be in close contact with the two clamping pieces, and thus, the wiring terminal and the terminal post are firmly connected delivering electrical energy. In some embodiments, the two clamping pieces are arc sheets.

In some embodiments, the top cover 11 of the cover body 1 is provided with positioning parts to prevent the electrical connectors 31 from disengaging from the wire guide slots 23 and to further fix the electrical connectors 31, and each positioning part is arranged towards one wire guide slot 23 and extend into one wire guide slot 23. Particularly, each positioning part includes at least two limiting ribs 26 and a limiting plate 27, wherein the limiting ribs 26 are arranged towards one wire guide slot 23 and extend into the wire guide slots 23, the limiting plate 27 is connected between the two limiting ribs 26 in the wire guide slot 23 and is not parallel to the axial direction of the wire guide slot 23. And a limiting groove 261 is defined by the two limiting ribs 26, the limiting plate 27 and the top cover 11 of the cover body. And the positioning grooves 261 are shorter than the wire guide slots 23 and are close to the wire guide ports 121. In some embodiments, the limiting plates 27 incline towards the bottom plate 21 from the wire guide ports 121. Each wiring terminal 3 further includes a connector and a resilient latch 33, wherein the connector is fixed at the other end of the two clamping pieces, away from the lead wire fixing base 32; and the resilient latch 33 is disposed upon the clamping gap 311, one end of the resilient latch 33 is fixed to the connector, and the other end of the resilient latch 33 extends towards the lead wire fixing base 32, so that the resilient latch 33 forms a flare angle with the upper plane of the clamping gap 311. When the electrical connector 31 is being inserted into the wire guide slot 23, the resilient latch 33 is pressed by the limiting plate 27 of the positioning part and the flare angle is compressed; after the electrical connector 31 has been inserted into the wire guide slot 23, the resilient latch 33 rebounds, and the flare angle is restored; and when the electrical connector 31 is being pulled along the wire guide slot 23 away from the cover body 1, the opening end of the resilient latch 33 is stuck in the positioning groove 261 making the electrical connector 31 fixed in the wire guide slot 23, so that the situation in which the electrical connector 31 gets loose and disengages from the wire guide slot 231 due to transportation, movement, or the like is avoided. In some embodiments, the limiting plates 27 incline towards the bottom plate 21 from the wire guide ports 121, and a plate is connected between the opening end of each limiting plate 27 and the top cover 11 and the plate is perpendicular to the top cover 11.

In some embodiments, in order to prevent the electrical connectors 31 in the wire guide slots 23 from being separated from the exposed lead wire fixing bases 32 due to the pulling force in the transportation or movement process, to reserve more space keeping the terminal posts away from the wire guide port 121 to prevent water and dust from entering the terminal posts, and to further effectively seal the electrical connectors 31 and the terminal posts, the wire fixing part 2 and the top cover 11 of the cover body stretch out of the side wall 12 at the wire guide ports 121. So after the electrical connectors 31 have been inserted into the wire guide slots 231 and have been in contact with the terminal posts, the remaining length of the wire guide slots 23 is sufficient to accommodate the lead wire fixing bases 32. In some embodiments, the connection of the electrical connectors 31 and the lead wire fixing bases 32 are more stable, and the sealing between the electrical connectors 31 and the terminal posts is enhanced.

Figure 12:
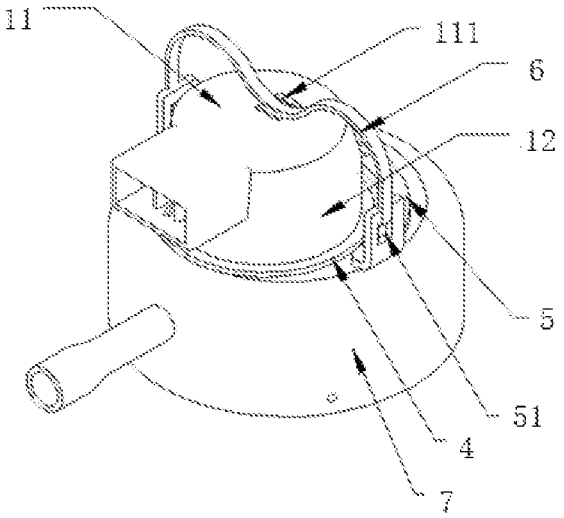
FIG. 12 is a structural view of the sealing cover mounted on a terminal post fixing base in some embodiments.
Figure 13:
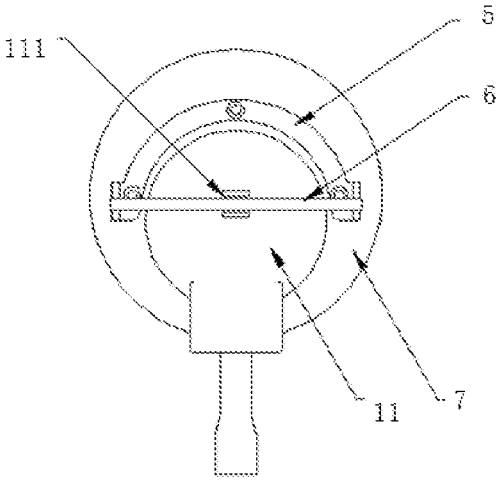
FIG. 13 is a top view of the structure shown in FIG. 12.
Figure 14:
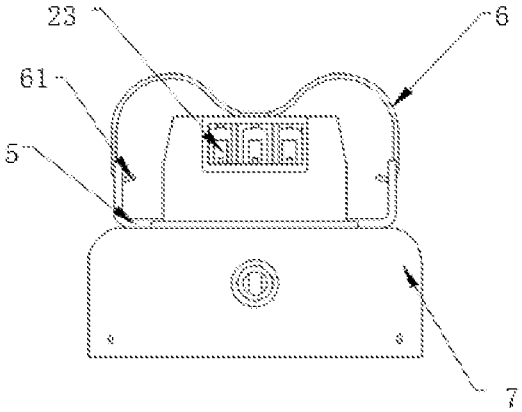
FIG. 14 is a side view of the structure shown in FIG. 12.

Please refer to FIG. 12-FIG. 14, wherein FIG. 12 is a structural view of the sealing cover arranged over the terminal post fixing base, FIG. 13 is a top view of the structure shown in FIG. 12, and FIG. 14 is a side view of the structure shown in FIG. 12. Wherein, the terminal post fixing base is embedded in an upper cover body 7 of an upper cover assembly.

The embodiments further provide an upper cover assembly. The upper cover assembly includes an upper cover body 7, a terminal post fixing base embedded in the upper cover body, terminal posts embedded in the upper cover body 7 and penetrating through the terminal post fixing base to be connected with a motor, and the sealing cover mentioned in any embodiments above, wherein the sealing cover is mounted on the terminal post fixing base.

In order to further improve the sealing effect, the upper cover assembly further includes a sealing ring 4, wherein the sealing ring 4 is disposed at the joint of the sealing cover and the terminal post fixing base and is firmly pressed by the sealing cover disposed around the terminal post fixing base, so that a gap between the sealing cover and the terminal post fixing base is reduced, and sealing between the sealing cover and the terminal post fixing base is enhanced.

In some embodiments, to further enhance the sealing between the sealing cover and the terminal post fixing base, the upper cover assembly further includes a rack 5 and a tightening strip 6, wherein the rack 5 is welded to the top surface of the terminal post fixing base and two symmetrical positions on the rack 5 stretch out forming two protuberances, and symmetrical hanging holes 51 are disposed at the protuberances of the rack 5. Hooks 61 to be hooked in the hanging holes 51 are symmetrically arranged on two ends of the tightening strip 6, and a tightening groove 111 used for accommodating the tightening strip 6 is disposed at the outer side of the top surface of the top cover 11; and the tightening strip 6 is a linear elastic structure. In order to enhance the sealing between the sealing cover and the terminal post fixing base, firstly weld the rack 5 to the top surface of the terminal post fixing base, and dispose the hanging holes 51 protruding out of the terminal post fixing base; then, hook the hooks 61 of the tightening strip 6 in the hanging holes 51 to fix the tightening strip 6 and the rack 5 together; and afterwards, press the tightening strip 6 towards the top cover 11 until the tightening strip 6 is clamped in the tightening groove 111 and the sealing ring 4 is firmly pressed by the sealing cover.

In order to assemble the upper cover assembly, first, insert the two clamping pieces 31 of the wiring terminal 3 into the wire guide slot 23 via the wire guide port 121, and the clamping gap 311 between the clamping pieces 31 would be propped open by the positioning bar 25, meanwhile, the wiring terminal 3 would be fixed in the wire guide slot 23. Afterwards, hold the sealing cover to cover the terminal post fixing base with the fitting space 14, then press the sealing cover to fix the fitting space 14 to the terminal post fixing base, meanwhile, the terminal post on the terminal post fixing base would penetrate through the guide hole 24 in the wire guide slot 23 to enter the clamping gap 311 between the two clamping pieces to be in close contact with the two clamping pieces, so that the sealing cover is assembled on the terminal post fixing base, and the terminal post and the wiring terminal 3 are connected. Then hook the hanging holes 51 of the rack 5 with the hooks 61 of the tightening strip 6. Last, press the tightening strip 6 towards the top cover 1 to make the tightening strip 6 be clamped in the tightening groove 111 in the top cover 11, then the sealing cover firmly would press against the sealing ring 4, sealing the gap between the sealing cover and the terminal post fixing base.

Figure 15:
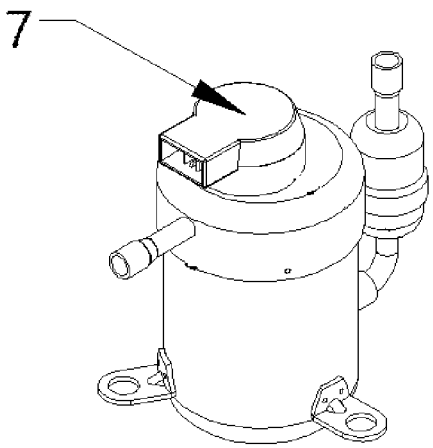
FIG. 15 is a perspective view of a compressor having a shell and an upper cover assembly mounted on the shell.

Some embodiments further provide a compressor, as shown in FIG. 15. The compressor includes a shell and an upper cover assembly mounted on the shell, wherein the shell includes a pump and a motor, and the upper cover assembly is the assembly structure mentioned in any of the embodiments above.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'including' does not exclude other steps or elements.

What is claimed:

1. A sealing cover, comprising:

a cover body, and a wire fixing part, and wiring terminals, wherein:

the cover body comprises a top cover and a side wall, and the cover body is of a half-surrounded structure;

the wire fixing part comprises a bottom plate and side plates, the bottom plate is arranged in the cover body, a wire accommodating space is defined by the bottom plate, the top cover and the side wall of the cover body, and a fitting space is formed between the side wall and a side of the bottom plate which is opposite to the wire accommodating space;

the side plates are arranged in the wire accommodating space and fixed vertically on the bottom plate, and each two adjacent side plates forms a wire guide slot with the bottom plate; and each wire guide slot is provided with a guide hole on the bottom plate;

the wire fixing part further comprises positioning bars arranged on the bottom plate at each wire guide slot, and the guide holes are located on the positioning bars;

each wiring terminal comprises an electrical connector and a lead wire fixing base, the electrical connector is fixedly connected to an end of the lead wire fixing base and is inserted into the wire guide slot, and the lead wire fixing base is exposed out of the wire guide slot; the electrical connector comprises two clamping pieces, one end of each of the two clamping pieces is fixed to the lead wire fixing base, the two clamping pieces are arranged symmetrically, and a clamping gap is formed between the two clamping pieces; and when the electrical connector is inserted into the wire guide slot, the positioning bar in the wire guide slot is clamped by the two clamping pieces, so that a lower side of the clamping gap is propped open by the positioning bar to fix the electrical connector, wherein a resilient latch of the connector stuck in a positioning groove of the fixing wire part.

2. The sealing cover of claim 1, wherein the top cover of the cover body is provided with positioning parts, and the positioning parts are arranged towards the wire guide slots and extend into the wire guide slots.

3. The sealing cover of claim 2, wherein each positioning part comprises at least two limiting ribs and a limiting plate, the limiting ribs are arranged towards the wire guide slot and extend into the wire guide slot, the limiting plate is connected between the two limiting ribs in the wire guide slot and is not parallel to an axial direction of the wire guide slot, and a limiting groove is defined by the two limiting ribs, the limiting plate, and the top cover of the cover body.

4. The sealing cover of claim 3, wherein each wiring terminal further comprises a connector and a resilient latch, wherein the connector is arranged and fixed at the same ends of the two clamping pieces which are far away from the lead wire fixing base, and the resilient latch is located on an upper side of the clamping gap formed between the two clamping pieces, the resilient latch has an end fixed to the connector and has another end extending towards the lead wire fixing base to form a flare angle with an upper side face of the clamping gap; when the electrical connector is inserted into the wire guide slot, the resilient latch is pressed by the limiting plate of the positioning part to compress the flange angle; after the electrical connector is inserted into the wire guide slot, the resilient latch rebounds, and then the flare angle is restored; and when the electrical connector is pulled along the wire guide slot in a direction away from the cover body, an end of the resilient latch is clamped in the limiting groove.

5. The sealing cover of claim 4, wherein the two clamping pieces are arc sheets.

6. The sealing cover of claim 1, wherein the inner structure of the cover body is selected from a group consisting of a part between the side plates of the wire fixing part and the side wall of the cover body is solid and a part between the side plate of the wire fixing part and the side wall of the cover body is hollow.

7. The sealing cover of claim 1, wherein wire guide ports are arranged at the side wall of the cover body and are communicated with the wire guide slots; the wire fixing part and the top cover of the cover body extend towards the wire guide ports to stretch out of the side wall of the cover body.

8. The sealing cover of claim 1, wherein the number of the wire guide slots formed between the bottom plate of the wire fixing part and the side plate of the wire fixing part is more than one.

9. An upper cover assembly, comprising:

an upper cover body, a terminal post fixing base embedded in the upper cover body, wiring terminals embedded in the upper cover body and penetrating through the terminal post fixing base to be connected with a motor, and a sealing cover mounted on the terminal post fixing base, wherein:

the sealing cover comprises a cover body and, a wire fixing part and wiring terminals;

the cover body comprises a top cover and a side wall and is of a half-surrounded structure;

the wire fixing part comprises a bottom plate and side plates, the bottom plate is arranged in the cover body, a wire accommodating space is defined by the bottom plate, the top cover and the side wall of the cover body, and a fitting space is formed between the side wall and a side of the bottom plate which is opposite to the wire accommodating space;

the side plates are arranged in the wire accommodating space and fixed vertically on the bottom plate, and each two adjacent side plates forms a wire guide slot with the bottom plate; and each wire guide slot is provided with a guide hole on the bottom plate; and the wire fixing part further comprises positioning bars arranged on the bottom plate at each wire guide slot, and the guide holes are located on the positioning bars;

each wiring terminal comprises an electrical connector and a lead wire fixing base, the electrical connector is fixedly connected to an end of the lead wire fixing base and is inserted into the wire guide slot, and the lead wire fixing base is exposed out of the wire guide slot the electrical connector comprises two clamping pieces, one end of each of the two clamping pieces is fixed to the lead wire fixing base, the two clamping pieces are arranged symmetrically, and a clamping gap is formed between the two clamping pieces; and when the electrical connector is inserted into the wire guide slot, the positioning bar in the wire guide slot is clamped by the two clamping pieces, so that a lower side of the clamping gap is propped open by the positioning bar to fix the electrical connector, wherein a resilient latch of the connector stuck in a positioning groove of the fixing wire part.

10. The upper cover assembly of claim 9, wherein the top cover of the cover body is provided with positioning parts, and the positioning parts are arranged towards the wire guide slots and extend into the wire guide slots; and each positioning part comprises at least two limiting ribs and a limiting plate, wherein the limiting ribs are arranged towards the wire guide slot and extend into the wire guide slot, the limiting plate is connected between the two limiting ribs in the wire guide slot and is not parallel to an axial direction of the wire guide slot, and a limiting groove is defined by the two limiting ribs, the limiting plate, and the top cover of the cover body.

11. The upper cover assembly of claim 10, wherein each wiring terminal further comprises a connector and a resilient latch, wherein the connector is arranged and fixed at the same ends of the two clamping pieces which are far away from the lead wire fixing base, and the resilient latch is located on an upper side of the clamping gap formed between the two clamping pieces, the resilient latch has an end fixed to the connector and has another end extending towards the lead wire fixing base to form a flare angle with an upper side face of the clamping gap; when the electrical connector is inserted into the wire guide slot, the resilient latch is pressed by the limiting plate of the positioning part to compress the flange angle; after the electrical connector is inserted into the wire guide slot, the resilient latch rebounds, and then the flare angle is restored; and when the electrical connector is pulled along the wire guide slot in a direction away from the cover body, an end of the resilient latch is clamped in the limiting groove; the upper cover assembly further comprises a sealing ring arranged at a joint of the sealing cover and the terminal post fixing base.

12. The upper cover assembly of claim 9, wherein the upper cover assembly further comprises a rack and a tightening strip; the rack is fixed to the terminal post fixing base; symmetrical hanging holes are arranged on two symmetrical protuberances of the rack; hooks to be hooked in the hanging holes are symmetrically arranged on two ends of the tightening strip; a tightening groove used for accommodating the tightening strip is arranged at an outer side of the top cover; and after the hooks of the tightening strip are hooked in the hanging holes of the rack, the tightening strip is pressed towards the top cover to be clamped and fixed in the tightening groove; the tightening strip is a linear elastic structure.

13. A compressor, comprising:

a shell, and an upper cover assembly mounted on the shell, wherein:

a pump and a motor assembly are arranged in the shell;

the upper cover assembly comprises an upper cover body, a terminal post fixing base embedded in the upper cover body, terminal posts embedded in the upper cover body and penetrating through the terminal post fixing base to be connected with a motor, and a sealing cover mounted on the terminal post fixing base;

the sealing cover comprises a cover body and, a wire fixing part and wiring terminals;

the cover body comprises a top cover and a side wall, and is of a half-surrounded structure;

the wire fixing part comprises a bottom plate and side plates, the bottom plate is arranged in the cover body, a wire accommodating space is formed by the top cover and the side wall of the cover body and the bottom plate, and a fitting space formed between the side wall and a side of the bottom plate which is opposite to the wire accommodating space;

the side plates are arranged in the wire accommodating space and fixed vertically on the bottom plate, and each two adjacent side plates forms a wire guide slot with the bottom plate; and each wire guide slot is provided with a guide hole on the bottom plate;

the wire fixing part further comprises positioning bars arranged on the bottom plate at each wire guide slot, and the guide holes are located on the positioning bars;

each wiring terminal comprises an electrical connector and a lead wire fixing base, the electrical connector is fixedly connected to an end of the lead wire fixing base and is inserted into the wire guide slot, and the lead wire fixing base is exposed out of the wire guide slot the electrical connector comprises two clamping pieces, one end of each of the two clamping pieces is fixed to the lead wire fixing base, the two clamping pieces are arranged symmetrically, and a clamping gap is formed between the two clamping pieces; and when the electrical connector is inserted into the wire guide slot, the positioning bar in the wire guide slot is clamped by the two clamping pieces, so that a lower side of the clamping gap is propped open by the positioning bar to fix the electrical connector, wherein a resilient latch of the connector stuck in a positioning groove of the fixing wire part.

14. The compressor of claim 13, wherein the top cover of the cover body is provided with positioning parts, and the positioning parts are arranged towards the wire guide slots and extend into the wire guide slots; and each positioning part comprises at least two limiting ribs and a limiting plate, wherein the limiting ribs are arranged towards the wire guide slot and extend into the wire guide slot, the limiting plate is connected between the two limiting ribs in the wire guide slot and is not parallel to an axial direction of the wire guide slot, and a limiting groove is defined by the two limiting ribs, the limiting plate, and the top cover of the cover body.

15. The compressor of claim 14, wherein each wiring terminal further comprises a connector and a resilient latch, wherein the connector is arranged and fixed at the same ends of the two clamping pieces which are far away from the lead wire fixing base, and the resilient latch is located on an upper side of the clamping gap formed between the two clamping pieces, the resilient latch has an end fixed to the connector and has another end extending towards the lead wire fixing base to form a flare angle with an upper side face of the clamping gap; when the electrical connector is inserted into the wire guide slot, the resilient latch is pressed by the limiting plate of the positioning part to compress the flange angle; after the electrical connector is inserted into the wire guide slot, the resilient latch rebounds, and then the flare angle is restored; and when the electrical connector is pulled along the wire guide slot in a direction away from the cover body, an end of the resilient latch is clamped in the limiting groove; the compressor further comprises a sealing ring arranged at a joint of the sealing cover and the terminal post fixing base.

16. The compressor of claim 15, wherein the compressor further comprises a rack and a tightening strip; the rack is fixed to the terminal post fixing base; symmetrical hanging holes are arranged on two symmetrical protuberances of the rack; hooks to be hooked in the hanging holes are symmetrically arranged on two ends of the tightening strip; a tightening groove used for accommodating the tightening strip is arranged at an outer side of the top cover; and after the hooks of the tightening strip are hooked in the hanging holes of the rack, the tightening strip is pressed towards the top cover to be clamped and fixed in the tightening groove.

* * * * *